US006435064B1

(12) United States Patent
Persechino

(10) Patent No.: US 6,435,064 B1
(45) Date of Patent: Aug. 20, 2002

(54) FROST PROOF SILL COCK EXTRACTION TOOL

(76) Inventor: Francis J. Persechino, 9250 Colby Ct., Guthrie, OK (US) 73044

( * ) Notice: Subject to any disclaimer, the term of this patent is extended or adjusted under 35 U.S.C. 154(b) by 0 days.

(21) Appl. No.: 09/747,841

(22) Filed: Dec. 26, 2000

(51) Int. Cl.[7] ..... B25B 23/02

(52) U.S. Cl. ..... 81/442; 81/447; 29/213.1; 403/370

(58) Field of Search ..... 81/442–447; 403/370; 29/213.1

(56) References Cited

U.S. PATENT DOCUMENTS

| | | | | |
|---|---|---|---|---|
| 612,489 | A | 10/1898 | Dean | |
| 1,364,496 | A | 1/1921 | Weaver | |
| 1,412,235 | A | 4/1922 | Felix | |
| 1,470,421 | A | * 10/1923 | Astley | 81/447 |
| 3,914,966 | A | 10/1975 | Bello | |
| 4,630,347 | A | 12/1986 | Chilton | |
| D317,241 | S | 6/1991 | Lent | |

* cited by examiner

*Primary Examiner*—D. S. Meislin

(57) ABSTRACT

A frost proof sill cock extraction tool for removing a broken sill cock. The frost proof sill cock extraction tool includes a bar. The bar is elongate and has a distal end and a proximal end. A peripheral wall extends between and is integrally coupled to the distal and proximal ends. The bar is generally hollow and has a hole extending through the distal and proximal ends. An outer surface of the peripheral wall positioned adjacent to the distal end is knurled. The bar has a break therein located generally adjacent to the distal end such that a first portion and a second portion of the bar is defined. The first portion abuts the distal end. The break extends from the peripheral wall to a point generally adjacent to the distal end in an angular relationship to a longitudinal axis of the bar. An inside surface of the first portion is threaded. A rod is elongate and has a first end and a second end. The rod has a threaded outer surface. The rod is extendably positioned through the first portion and is threadably couplable to the first portion. Rotating the rod in a first direction urges the first portion toward the second portion such that the first and second portions define an expansion bolt. The rod has a length greater than the bar.

13 Claims, 3 Drawing Sheets

FROST PROOF SILL COCK EXTRACTION TOOL

BACKGROUND OF THE INVENTION

1. Field of the Invention

The present invention relates to sill cock removal devices and more particularly pertains to a new frost proof sill cock extraction tool for removing a broken sill cock.

2. Description of the Prior Art

The use of sill cock removal devices is known in the prior art. More specifically, sill cock removal devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 612,489; U.S. Pat. No. 1,364,496; U.S. Pat. No. 1,412,235; U.S. Pat. No. 3,914,966; U.S. Pat. No. 4,630,347; and U.S. Des. Pat. No. 317,214.

While these devices fulfill their respective, particular objectives and requirements, the aforementioned patents do not disclose a new frost proof sill cock extraction tool. The inventive device includes a bar. The bar is elongate and has a distal end and a proximal end. A peripheral wall extends between and is integrally coupled to the distal and proximal ends. The bar is generally hollow and has a hole extending through the distal and proximal ends. An outer surface of the peripheral wall positioned adjacent to the distal end is knurled. The bar has a break therein located generally adjacent to the distal end such that a first portion and a second portion of the bar is defined. The first portion abuts the distal end. The break extends from the peripheral wall to a point generally adjacent to the distal end in an angular relationship to a longitudinal axis of the bar. An inside surface of the first portion is threaded. A rod is elongate and has a first end and a second end. The rod has a threaded outer surface. The rod is extendably positioned through the first portion and is threadably couplable to the first portion. Rotating the rod in a first direction urges the first portion toward the second portion such that the first and second portions define an expansion bolt. The rod has a length greater than the bar.

In these respects, the frost proof sill cock extraction tool according to the present invention substantially departs from the conventional concepts and designs of the prior art, and in so doing provides an apparatus primarily developed for the purpose of removing a broken sill cock.

SUMMARY OF THE INVENTION

In view of the foregoing disadvantages inherent in the known types of sill cock removal devices now present in the prior art, the present invention provides a new frost proof sill cock extraction tool construction wherein the same can be utilized for removing a broken sill cock.

The general purpose of the present invention, which will be described subsequently in greater detail, is to provide a new frost proof sill cock extraction tool apparatus and method which has many of the advantages of the sill cock removal devices mentioned heretofore and many novel features that result in a new frost proof sill cock extraction tool which is not anticipated, rendered obvious, suggested, or even implied by any of the prior art sill cock removal devices, either alone or in any combination thereof.

To attain this, the present invention generally comprises a bar. The bar is elongate and has a distal end and a proximal end. A peripheral wall extends between and is integrally coupled to the distal and proximal ends. The bar is generally hollow and has a hole extending through the distal and proximal ends. An outer surface of the peripheral wall positioned adjacent to the distal end is knurled. The bar has a break therein located generally adjacent to the distal end such that a first portion and a second portion of the bar is defined. The first portion abuts the distal end. The break extends from the peripheral wall to a point generally adjacent to the distal end in an angular relationship to a longitudinal axis of the bar. An inside surface of the first portion is threaded. A rod is elongate and has a first end and a second end. The rod has a threaded outer surface. The rod is extendably positioned through the first portion and is threadably couplable to the first portion. Rotating the rod in a first direction urges the first portion toward the second portion such that the first and second portions define an expansion bolt. The rod has a length greater than the bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new frost proof sill cock extraction tool apparatus and method which has many of the advantages of the sill cock removal devices mentioned heretofore and many novel features that result in a new frost proof sill cock extraction tool which is not anticipated, rendered obvious, suggested, or even implied by any of the prior art sill cock removal devices, either alone or in any combination thereof.

It is another object of the present invention to provide a new frost proof sill cock extraction tool which may be easily and efficiently manufactured and marketed.

It is a further object of the present invention to provide a new frost proof sill cock extraction tool which is of a durable and reliable construction.

An even further object of the present invention is to provide a new frost proof sill cock extraction tool which is susceptible of a low cost of manufacture with regard to both materials and labor, and which accordingly is then susceptible of low prices of sale to the consuming public, thereby making such frost proof sill cock extraction tool economically available to the buying public.

Still yet another object of the present invention is to provide a new frost proof sill cock extraction tool which provides in the apparatuses and methods of the prior art some of the advantages thereof, while simultaneously overcoming some of the disadvantages normally associated therewith.

Still another object of the present invention is to provide a new frost proof sill cock extraction tool for removing a broken sill cock.

Yet another object of the present invention is to provide a new frost proof sill cock extraction tool which includes a bar. The bar is elongate and has a distal end and a proximal end. A peripheral wall extends between and is integrally coupled to the distal and proximal ends. The bar is generally hollow and has a hole extending through the distal and proximal ends. An outer surface of the peripheral wall positioned adjacent to the distal end is knurled. The bar has a break therein located generally adjacent to the distal end such that a first portion and a second portion of the bar is defined. The first portion abuts the distal end. The break extends from the peripheral wall to a point generally adjacent to the distal end in an angular relationship to a longitudinal axis of the bar. An inside surface of the first portion is threaded. A rod is elongate and has a first end and a second end. The rod has a threaded outer surface. The rod is extendably positioned through the first portion and is threadably couplable to the first portion. Rotating the rod in a first direction urges the first portion toward the second portion such that the first and second portions define an expansion bolt. The rod has a length greater than the bar.

Still yet another object of the present invention is to provide a new frost proof sill cock extraction tool that allows a person to remove a sill cock which has broken into two pieces, where an inner of the two pieces is removably coupled to an outlet pipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
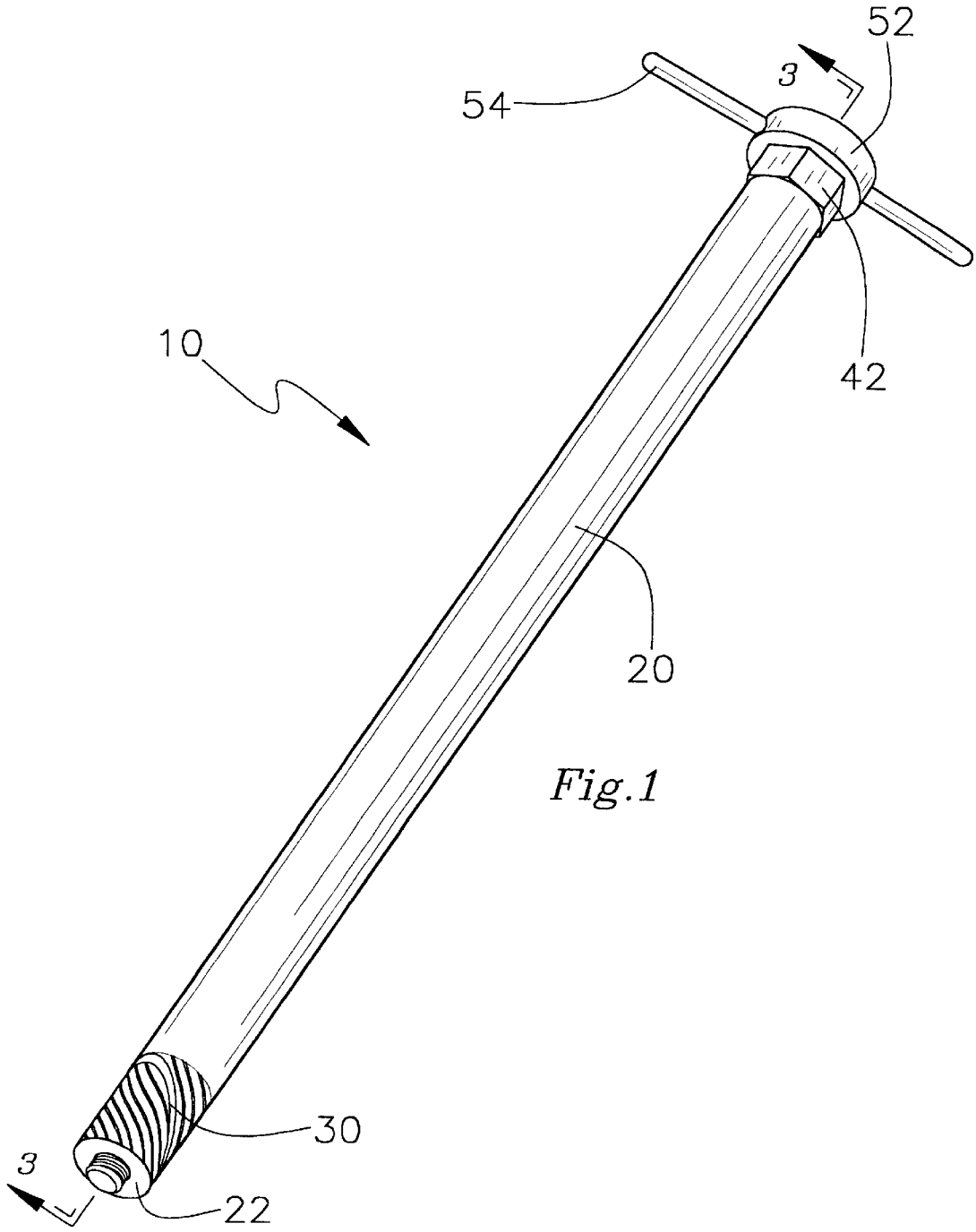
FIG. 1 is a schematic perspective view of a new frost proof sill cock extraction tool according to the present invention.
Figure 2:
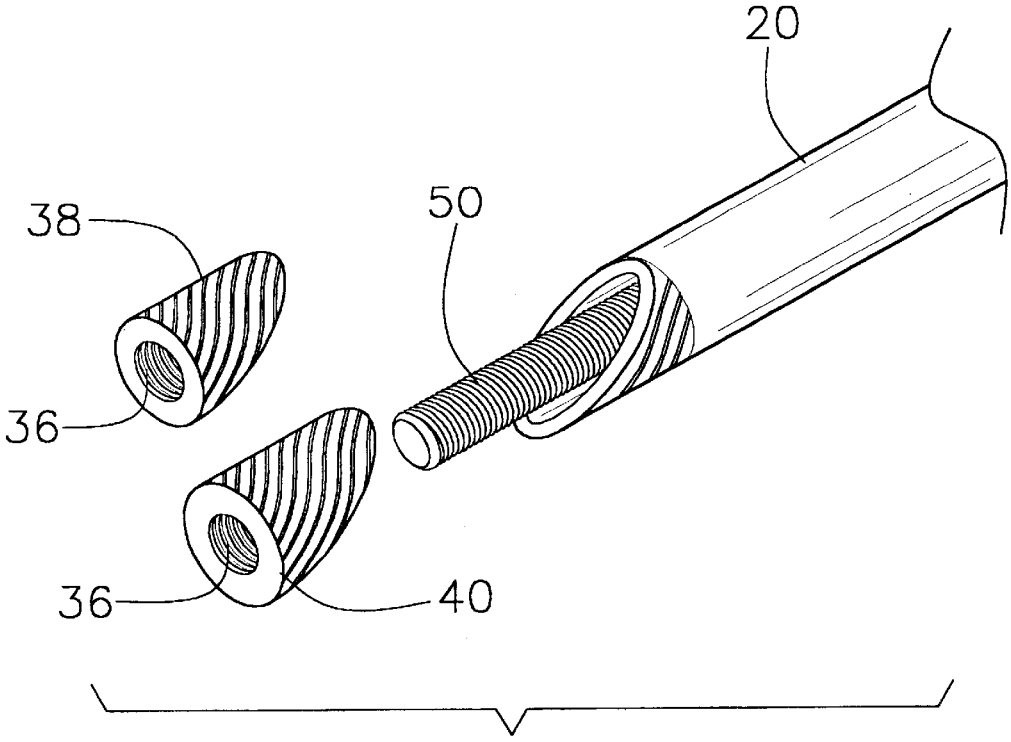
FIG. 2 is a schematic exploded perspective view of the first portions of the present invention.
Figure 3:
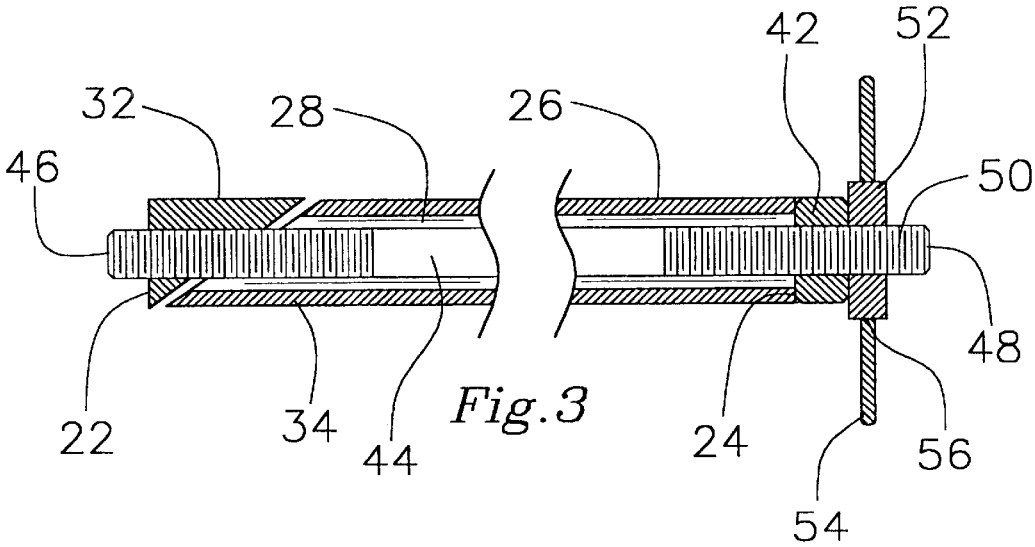
FIG. 3 is a schematic cross-sectional view of the present invention taken along line 3—3.
Figure 4:
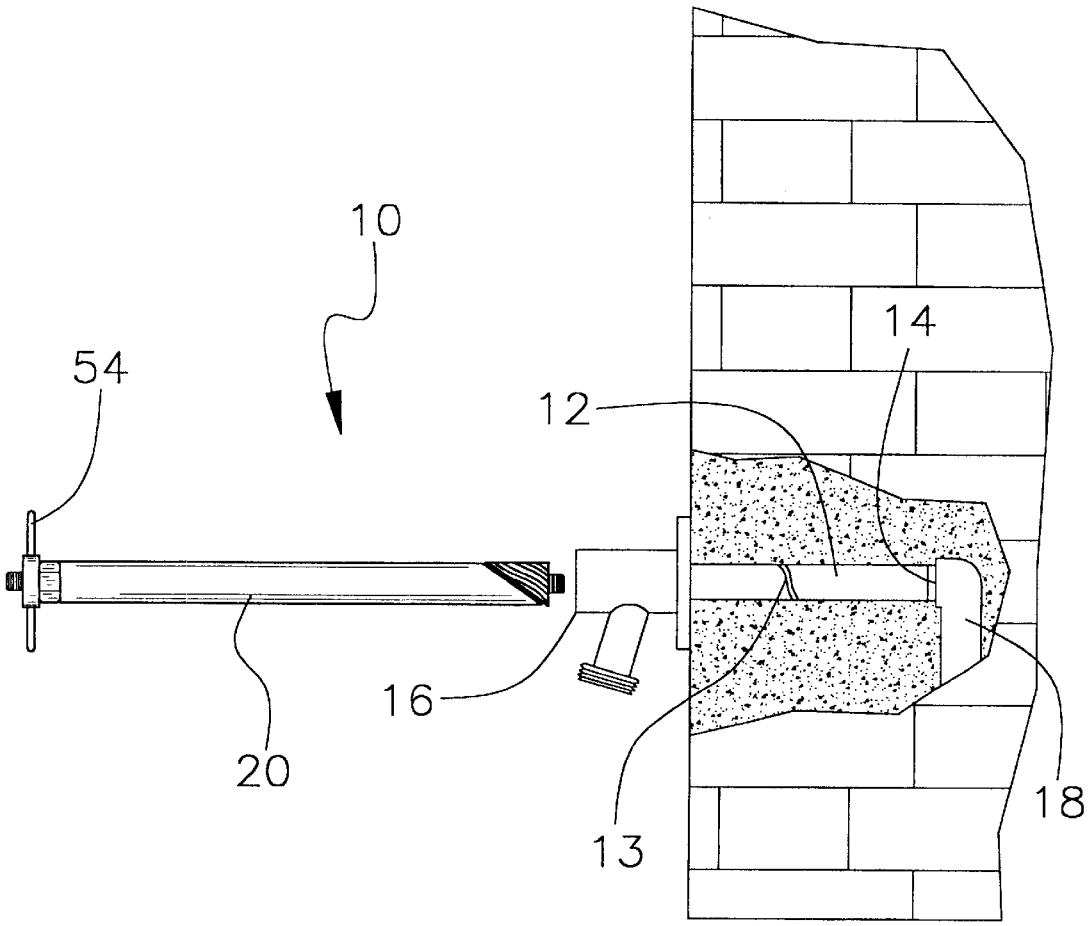
FIG. 4 is a schematic side in use-view of the present invention.

With reference now to the drawings, and in particular to FIGS. 1 through 4 thereof, a new frost proof sill cock extraction tool embodying the principles and concepts of the present invention and generally designated by the reference numeral 10 will be described.

As best illustrated in FIGS. 1 through 4, the frost proof sill cock extraction tool 10 generally comprises a sill cock extraction tool. The sill cock is a conventional frost proof sill cock 12 having a first end 14 and a second end 16. The first end 14 is removably coupled to an outlet pipe 18.

The device 10 includes a bar 20 that is elongate and has a distal end 22 and a proximal end 24. A peripheral wall 26 extends between and is integrally coupled to the distal 22 and proximal 24 ends. The bar 20 is generally hollow and has a hole 28 extending through the distal 22 and proximal 24 ends. An outer surface of the peripheral wall 26 positioned adjacent to the distal end 22 is knurled. The bar 20 has a break 30 therein. The break 30 is located generally adjacent to the distal end 22 such that a first portion 32 and a second portion 34 are defined. The first portion 32 abuts the distal end 22. The hole 28 in the second portion 34 has a larger diameter than the hole in the first portion 32. The break 30 extends from the peripheral wall 26 to a point generally adjacent to the distal end 22 at an angle. The angle of the break 30 is generally equal to 30 degrees with respect to a longitudinal axis of the bar 20. An inside surface 36 of the first portion 22 is threaded. The bar 20 has a length generally between 14 inches and 20 inches. The bar 20 generally has a width less then 1 inch.

Ideally, the first portion 32 may be selected from a plurality of first portions each having a different width. Preferably, a first 38 of the first portions has a width generally between ⅝ inches and ¾ inches, and second 40 of the first portions has a width generally between ¾ inches and ⅞ inches.

A nut 42 is securely coupled to the proximal end 24 of the bar 20. The nut 42 has an opening extending therethrough. The opening in the nut 42 is generally coaxial with the hole 28 in the bar 20. The nut 42 is threaded.

A rod 44 is elongate and has a first end 46 and a second end 48. The rod 44 has a threaded outer surface 50. The rod 44 is extendably positioned through the first portion 32 and the nut 42 such that the first end 46 of the rod 44 extends outwardly away from the first portion 32 and the second end 48 of the rod 44 extends outwardly away from the nut 42. The rod 44 is threadably couplable to the nut 42 and the first portion 32. Rotating the rod 44 in a first direction urges the first portion 32 toward the second portion 34 such that the first and second portions define an expansion bolt. The rod 44 has a length greater than the bar 20. Preferably, the rod 44 has a length generally between 18 inches and 22 inches and has a width generally equal to ¼ inch.

The rod 44 extends through and is securely attached to an annular member 52. The annular member 52 is positioned between the second end 48 of the rod and the nut 42.

Each of a plurality of elongate members 54 has an end 56 integrally coupled to the annular member 52 such that each of the elongate members 54 radially extend outwardly from the annular member 52 to define a handle for rotating the rod 44.

In use, the bar 20 is extended into a broken sill cock 12 such that the first portion 32 is positioned at a juncture of the sill cock 12 and the outlet pipe 18 or relatively nearby that juncture. The rod 44 is rotated in the first direction such that the expansion bolt frictionally engages the sill cock 12 by increasing the diameter of the bar 20 as the first portion 32 rides up the second portion 34. The bar 20 is rotated in a second direction such that the sill cock 12 and is disengaged from the outlet pipe 18. In the opposite technique may then be used to insert a new frost proof sill cock 12. The tool 10 allows the user to grip a portion of the sill cock 12 beyond its break 13 which is positioned in the wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sill cock extraction tool, the sill cock having a first end and a second end, the first end being removably coupled to an outlet pipe, said tool comprising:

a bar being elongate and having a distal end and a proximal end, a peripheral wall extending between and being integrally coupled to said distal and proximal ends, said bar being generally hollow and having a hole extending through said distal and proximal ends, an outer surface of said peripheral wall positioned adjacent to said distal end being knurled, said bar having a break therein, said break being located generally adjacent to said distal end such that a first portion and a second portion are defined, said hole having a larger diameter in said second portion than said first portion, wherein said first portion abuts said distal end, said break extending from said peripheral wall to a point generally adjacent to said distal end in an angular relationship to a longitudinal axis of said bar, an inside surface of said first portion being threaded, said first portion being selected from a plurality of first portions, each of said first portions having a different width, a first of said first portions having a width between approximately ⅝ inches and approximately ¾ inches, and a second of said first portions having a width between approximately ¾ inches and approximately ⅞ inches;

a rod being elongate and having a first end and a second end, said rod having a threaded outer surface, said rod being extendably positioned through said first portion, said rod being threadably couplable to said first portion, wherein rotating said rod in a first direction urges said first portion toward said second portion such that an expansion bolt is defined by said first and second portions, said rod having a length greater than said bar.

2. The sill cock extraction tool as in claim 1, wherein said angle of said break is generally equal to 30 degrees with respect to said longitudinal axis of said bar.

3. The sill cock extraction tool as in claim 1, wherein said bar has a length generally between 14 inches and 20 inches.

4. The sill cock extraction tool as in claim 2, further including:

a nut being securely coupled to said proximal end of said bar, said nut having an opening extending therethrough, said opening in said nut being generally coaxial with said hole in said bar, said nut being threaded; and said rod being extendably positioned through said first portion and said nut such that said first end of said rod extends outwardly away from said first portion and said second end of said rod extends outwardly away from said nut, said rod being threadably couplable to said nut and said first portion.

5. The sill cock extraction tool as in claim 1, further including:

a nut being securely coupled to said proximal end of said bar, said nut having an opening extending therethrough, said opening in said nut being generally coaxial with said hole in said bar, said nut being threaded; and said rod being extendably positioned through said first portion and said nut such that said first end of said rod extends outwardly away from said first portion and said second end of said rod extends outwardly away from said nut, said rod being threadably couplable to said nut and said first portion.

6. The sill cock extraction tool as in claim 5, further including:

an annular member, said rod extending through said annular member and being securely attached thereto, said annular member being positioned between said second end of said rod and said nut; and a plurality of elongate members, each of said elongate members having an end integrally coupled to said annular member such that each of said elongate members radially extend outwardly from said annular member.

7. The sill cock extraction tool as in claim 3, further including:

a nut being securely coupled to said proximal end of said bar, said nut having an opening extending therethrough, said opening in said nut being generally coaxial with said hole in said bar, said nut being threaded; and said rod being extendably positioned through said first portion and said nut such that said first end of said rod extends outwardly away from said first portion and said second end of said rod extends outwardly away from said nut, said rod being threadably couplable to said nut and said first portion.

8. The sill cock extraction tool as in claim 7, further including:

an annular member, said rod extending through said annular member and being securely attached thereto, said annular member being positioned between said second end of said rod and said nut; and a plurality of elongate members, each of said elongate members having an end integrally coupled to said annular member such that each of said elongate members radially extend outwardly from said annular member.

9. A sill cock extraction tool, the sill cock having a first end and a second end, the first end being removably coupled to an outlet pipe, said tool comprising:

a bar being elongate and having a distal end and a proximal end, a peripheral wall extending between and being integrally coupled to said distal and proximal ends, said bar being generally hollow and having a hole extending through said distal and proximal ends, an outer surface of said peripheral wall positioned adjacent to said distal end being knurled, said bar having a break therein, said break being located generally adjacent to said distal end such that a first portion and a second portion are defined, said hole having a larger diameter in said second portion than said first portion, wherein said first portion abuts said distal end, said break extending from said peripheral wall to a point generally adjacent to said distal end at an angle, said angle of said break being generally equal to 30 degrees with respect to a longitudinal axis of said bar, an inside surface of said first portion being threaded, said bar having a length generally between 14 inches and 20 inches, said bar generally having a width less then 1 inch, wherein said first portion may be selected from a plurality of first portions, each of said first portions having a different width, a first of said first portions having a width generally between ⅝ inches and ¾ inches, a second of said first portions having a width generally between ¾ inches and ⅞ inches;

a nut being securely coupled to said proximal end of said bar, said nut having an opening extending therethrough, said opening in said nut being generally coaxial with said hole in said bar, said nut being threaded;

a rod being elongate and having a first end and a second end, said rod having a threaded outer surface, said rod being extendably positioned through said first portion and said nut such that said first end of said rod extends outwardly away from said first portion and said second end of said rod extends outwardly away from said nut, said rod being threadably couplable to said nut and said first portion, wherein rotating said rod in a first direction urges said first portion toward said second portion such that an expansion bolt is defined by said first and second portions, said rod having a length generally between 18 inches and 22 inches, said rod having a width generally equal to ¼ inch;

an annular member, said rod extending through said annular member and being securely attached thereto, said annular member being positioned between said second end of said rod and said nut;

a plurality of elongate members, each of said elongate members having an end integrally coupled to said annular member such that each of said elongate members radially extend outwardly from said annular member; and wherein said bar is extended into the sill cock such that said first portion is positioned at a juncture of the sill cock and the outlet pipe, wherein said rod is rotated in said first direction such that said expansion bolt frictionally engages the sill cock, wherein said bar is rotated in a second direction such that the sill cock is disengaged from the outlet pipe.

10. A sill cock extraction tool, the sill cock having a first end and a second end, the first end being removably coupled to an outlet pipe, said tool comprising:

a bar being elongate and having a distal end and a proximal end, a peripheral wall extending between and being integrally coupled to said distal and proximal ends, said bar being generally hollow and having a hole extending through said distal and proximal ends, an outer surface of said peripheral wall positioned adjacent to said distal end being knurled, said bar having a break therein, said break being located generally adjacent to said distal end such that a first portion and a second portion are defined, said hole having a larger diameter in said second portion than said first portion, wherein said first portion abuts said distal end, said break extending from said peripheral wall to a point generally adjacent to said distal end in an angular relationship to a longitudinal axis of said bar, an inside surface of said first portion being threaded;

an elongate rod having a first end and a second end, said rod having a threaded outer surface, said rod being extendably positioned through said first portion, said rod being threadably couplable to said first portion, wherein rotating said rod in a first direction urges said first portion toward said second portion such that an expansion bolt is defined by said first and second portions, said rod having a length greater than said bar;

a nut being securely coupled to said proximal end of said bar, said nut having an opening extending therethrough, said opening in said nut being generally coaxial with said hole in said bar, said nut being threaded, said rod being extendably positioned through said first portion and said nut such that said first end of said rod extends outwardly away from said first portion and said second end of said rod extends outwardly away from said nut, said rod being threadably couplable to said nut and said first portion;

an annular member, said rod extending through said annular member and being securely attached thereto, said annular member being positioned between said second end of said rod and said nut; and a plurality of elongate members, each of said elongate members having an end integrally coupled to said annular member such that each of said elongate members radially extends outwardly from said annular member.

11. The sill cock extraction tool as in claim 10, wherein said angle of said break is generally equal to 30 degrees with respect to said longitudinal axis of said bar.

12. The sill cock extraction tool as in claim 10, wherein said first portion may be selected from a plurality of first portions, each of said first portions having a different width, a first of said first portions having a width generally between ⅝ inches and ¾ inches, a second of said first portions having a width generally between ¾ inches and ⅞ inches.

13. The sill cock extraction tool as in claim 11, wherein said first portion may be selected from a plurality of first portions, each of said first portions having a different width, a first of said first portions having a width generally between ⅝ inches and ¾ inches, a second of said first portions having a width generally between ¾ inches and ⅞ inches.

* * * * *